US006669789B1

(12) United States Patent
Edelman et al.

(10) Patent No.: US 6,669,789 B1
(45) Date of Patent: Dec. 30, 2003

(54) METHOD FOR PRODUCING TITANIUM-BEARING MICROALLOYED HIGH-STRENGTH LOW-ALLOY STEEL

(75) Inventors: Daniel Geoffrey Edelman, Indianapolis, IN (US); Steven Leonard Wigman, Brownsburg, IN (US)

(73) Assignee: Nucor Corporation, Charlotte, NC (US)

( * ) Notice: Subject to any disclaimer, the term of this patent is extended or adjusted under 35 U.S.C. 154(b) by 66 days.

(21) Appl. No.: 09/945,185

(22) Filed: Aug. 31, 2001

(51) Int. Cl.[7] ..... C22C 38/14; C22C 38/06; C21D 8/02

(52) U.S. Cl. ..... 148/320; 420/126; 420/128; 148/541; 148/546; 148/547

(58) Field of Search ..... 148/320, 541, 148/546, 547; 420/126, 128

(56) References Cited

U.S. PATENT DOCUMENTS

| | | | | |
|---|---|---|---|---|
| 3,492,173 | A | 1/1970 | Goodenow | 148/12 |
| 3,625,780 | A | 12/1971 | Bosch et al. | 148/134 |
| 3,680,623 | A | 8/1972 | Tarmann et al. | 164/76 |
| 3,997,372 | A | 12/1976 | Matas et al. | 148/36 |
| 4,043,382 | A | 8/1977 | Saito et al. | 164/76 |
| 4,082,576 | A | 4/1978 | Lake et al. | 148/12 |
| 4,123,261 | A | 10/1978 | Moren et al. | 75/125 |
| 4,141,761 | A | 2/1979 | Abraham et al. | 148/36 |
| 4,328,032 | A | 5/1982 | Mancini et al. | 75/124 |
| 4,472,208 | A | 9/1984 | Kunishige | 148/12 |
| 4,824,492 | A | 4/1989 | Wright | 148/12.4 |
| 4,878,960 | A | 11/1989 | Sakai et al. | 148/127 |
| 4,925,500 | A | 5/1990 | Kishida et al. | 148/12 |
| 5,326,527 | A | 7/1994 | Bodnar et al. | 420/126 |
| 5,352,304 | A | 10/1994 | DeArdo et al. | 148/336 |
| 5,421,920 | A | 6/1995 | Yamamoto et al. | 148/546 |
| 5,507,886 | A | 4/1996 | Bodnar et al. | 148/541 |
| 5,514,227 | A | 5/1996 | Bodnar et al. | 148/541 |
| 5,554,235 | A | 9/1996 | Noe et al. | 148/610 |
| 5,592,988 | A | 1/1997 | Meroni et al. | 164/478 |
| 5,630,467 | A | 5/1997 | Yoshimura et al. | 164/486 |
| 5,759,297 | A | 6/1998 | Teracher et al. | 148/320 |

(List continued on next page.)

OTHER PUBLICATIONS

V. Leroy and J.C. Herman, "The Microstructure and Properties of Steels Processed by Thin Slab Casting", pp. 213–223, Microalloying '95 Conference Proceedings.

F.B. Pickering, "Titanium Nitride technology", pp. 79–104, Microalloyed Vanadium Steels Proceeding of the International Symposium in Cracow Apr. 24–26, 1990.

A.J. DeArdo, G.A. Ratz, and P.J. Wray, eds., "Thermomechanical Processing of Microalloyed Austenite", 1982, cover page, copyright page, xi, xiii–xvi, 267–292, 555–574, 641–671.

(List continued on next page.)

*Primary Examiner*—Deborah Yee
(74) *Attorney, Agent, or Firm*—Moore & Van Allen, PLLC; Matthew W. Witsil

(57) ABSTRACT

A composition and method of making a high-strength low-alloy hot-rolled steel sheet, strip, or plate bearing titanium as the principal or only microalloy strengthening element. The steel is substantially ferritic and has a microstructure that is at least 20% acicular ferrite. The steel has a minimum yield strength of at least 345 MPa (50 ksi) and even over 621 MPa (90 ksi) adding titanium as the lone microalloy element for strengthening, with elongation of 15% and more. Addition of vanadium, niobium, or a combination thereof can result in yield strengths exceeding 621 MPa (90 ksi). Effective titanium content, being the content of titanium in the steel not in the form of nitrides, oxides, or sulfides, is in the range of 0.01 to 0.12% by weight. The manufacturing process includes continuously casting a thin slab and reducing the slab thickness using thermomechanical controlled processing, including dynamic recrystallization controlled rolling.

10 Claims, 5 Drawing Sheets

U.S. PATENT DOCUMENTS

| | | | | |
|---|---|---|---|---|
| 5,853,043 | A | 12/1998 | Takeuchi et al. | 164/476 |
| 5,972,129 | A | 10/1999 | Beguinot et al. | 148/328 |
| 6,030,470 | A | 2/2000 | Hensger et al. | 148/541 |
| 6,066,212 | A | 5/2000 | Koo et al. | 148/336 |
| 6,117,389 | A | 9/2000 | Nabeshima et al. | 420/83 |
| 6,231,696 | B1 | 5/2001 | Hensger et al. | 148/541 |

OTHER PUBLICATIONS

Imao Tamura, Hiroshi Sekine, Tomo Tanaka, and Chiaki Ouchi, Thermomechanical Processing of High–stength Low–alloy Steels, pp. 80–106, 154–163, and 182–186. Butterworth & Co. (Publishers) Ltd, 1988.

Thermomechanical Processing in Theory, Modelling and Practice [TMP]$^2$, The Swedish Society for Materials Technology, 1997.

T. Chandra and T. Sakai, "THERMEC'97", International Conference on Thermomechanical Processing of Steels and Other Materials vol. 1, D.T. Lyewellyn and R.C. Hudd, Steels: Metallurgy and Applications, Butterworth–Heinemann, Third Edition 1998.

"Characteristic Feature of Titanium, Vanadium and Niobium as Microalloy Additions to Steels", http://www.cbmm.com.br/portug/sources/techlib/info/charact/charact.htm, print date Mar. 16, 2001.

"Fundamentals of the Controlled rolling Process", http://www.us.cbmm.com.br/english/sources/techlib/info/fundroll/funoroll.htm.

METHOD FOR PRODUCING TITANIUM-BEARING MICROALLOYED HIGH-STRENGTH LOW-ALLOY STEEL

TECHNICAL FIELD

The present invention relates to the field of high-strength low-alloy steel, and more particularly to compositions and methods for making high-strength low-alloy steel using titanium as the only, or as a principal, microalloy element for strengthening.

BACKGROUND

High-strength low-alloy (HSLA) steels conventionally use the alloying elements of vanadium, niobium, or combinations thereof for precipitation strengthening and grain refinement. Titanium is also used in combination with these elements. Relatively small amounts of the alloying elements, generally up to 0.10% by weight, are used to attain a yield strength of at least 275 MPa (40 ksi) in order for the steel to be considered high-strength. Of these alloying elements, titanium is the least expensive.

As known, titanium added to steel serves to limit austenitic grain growth in fully killed steels. Titanium induces precipitation of several compounds that form on cooling of the steel, including titanium nitride, (TiN), titanium carbide (TiC), and titanium carbonitride (Ti(C, N)). The first to form is TiN, which has three effects. The first effect is that precipitation of TiN eliminates free nitrogen from the steel. Free nitrogen in the steel is known to reduce toughness. Second, fine dispersion of TiN in the steel matrix limits grain growth, leading to grain size refinement during reheating. Third, TiN increases impact toughness at heat affected zones that are created through operations such as welding. Precipitation of TiN in liquid steel needs to be minimized, because these precipitates can be relatively coarse and have a size of up to 1 $\mu$m or more. Coarse TiN precipitates can have negative impacts on the steel because they are sharp-angled and relatively few in number, limiting the hardening and refining of the microstructure and degrading toughness and ductility. For the purpose of TiN formation, it is conventionally thought that titanium content should not exceed 0.03% by weight in order to minimize TiN precipitation in liquid steel, along with its detrimental effects.

Formation of titanium carbides and carbonitrides requires additional titanium in the steel, and because of the limitation placed on the titanium content, are generally not substantially present. Vanadium and niobium carbides, nitrides, and carbonitrides are the primary precipitate strengthening agents in microalloyed steel.

Also as known, thin slab casting is an improvement over conventional thick slab casting, both of which may be done as continuous casting processes. Thin slabs are cast in thicknesses generally ranging from 25 to 100 mm (1 to 4 inches), while thick slabs are generally from 200 to 300 mm (8 to 12 inches). Both thick and thin slab continuous casting generally involve the steps of smelting the steel in either a Basic Oxygen Furnace or an Electric Arc Furnace, tapping the furnace into a ladle, continuing to heat the steel in the ladle in a Ladle Metallurgy Furnace, where alloys are added to create the desired chemical composition, and transferring the steel from the ladle to a tundish from which the steel flows through a water-cooled mold. The steel begins to solidify by forming a shell as it passes through the mold. Rolls downstream of the mold work with gravity to control and guide the steel strand through the mold. Thin slab casting eliminates an entire stage of processing, the roughing hot work, that is applied to thick slabs. In general after cooling and solidifying, both thick and thin slabs are reheated and hot-rolled, using various processes of controlled rolling. The temperature of the steel may be reduced by a combination of air cooling and quenching with sprayed water. A combination of controlled rolling and accelerated cooling may be performed that is referred to as thermomechanical controlled processing, and such processing may be used to attain desired characteristics and microstructure in the steel. The rolled steel is then coiled.

Titanium is conventionally thought to be inadequate to attain higher yield strengths in thin slab casting without being used in combination with vanadium or niobium. In general, such thin slab cast, low carbon microalloy steels have a microstructure of polygonal ferrite combined with pearlite, and sometimes combined with bainite. An additional desirable microstructure that may be achievable through controlled rolling with addition of niobium or vanadium is acicular ferrite. Acicular ferrite, when combined with polygonal ferrite, results in steel with improved strength and toughness.

Accordingly, a process is needed to make HSLA steel with titanium, a less expensive alloy for strengthening than either vanadium or niobium, without the expensive processing that is required by conventional thick slab casting. The steel produced should have a microstructure providing desired high strength and other beneficial characteristics.

DISCLOSURE OF INVENTION

According to the present invention, a composition and method of making a high-strength low-alloy hot-rolled steel sheet, strip, or plate bearing titanium as the principal or only microalloy strengthening element are provided. The steel is substantially ferritic and has a microstructure that is at least 20% acicular ferrite, and has a minimum yield strength of 345 MPa (50 ksi). The steel is continuously cast, hot-rolled carbon steel with high strength and having a chemical composition by percent weight including:

$0.01 \leqq C \leqq 0.20$;

$0.5 \leqq Mn \leqq 3.0$;

$0.008 \leqq N \leqq 0.03$;

0:5S≦S0.5;

$0.01 \leqq Ti_{eff} \leqq 0.12$;

$0.005 \leqq Al \leqq 0.08$;

$0 \leqq Si \leqq 2.0$;

$0Cr \leqq 1.0$;

$0 \leqq Mo \leqq 1.0$;

$0 \leqq Cu \leqq 3.0$;

$0 \leqq Ni \leqq 1.5$;

$0 \leqq B \leqq 0.1$; and $0 \leqq P \leqq 0.5$, with the balance being iron and incidental impurities. $Ti_{eff}$ is the effective content of titanium in the cast steel, which is the content of titanium not in the form of nitrides, sulfides, or oxides. Acicular ferrite increases with increases in $Ti_{eff}$, as does strength.

In further accordance with the present invention, a steel is provided that has a tensile strength that exceeds yield strength by 69 MPa (10 ksi) and more. A majority of the acicular ferrite grains have an average grain size less than approximately 4 $\mu$m, as measured by x-ray diffraction and calculated by the Scherrer formula based on the {110}, {200}, and {211} Bragg peaks for Fe, and increased by a factor of ten.

Steel according to the present invention may further include niobium, vanadium, zirconium, or combinations thereof, in amounts up to 0.15% by weight of each microalloying element. Such addition can result in steel having a yield strength in excess of 621 MPa (90 ksi).

In yet further accord with the present invention, a process for manufacturing a hot-rolled carbon steel with high strength is provided that includes desulfurizing and deoxidizing a molten carbon steel, adding titanium, continuously casting the molten steel as a thin slab and having a composition as recited above, hot-rolling the thin slab to an approximate final thickness of from 1.8 mm to 13 mm (0.07-inches to 0.5-inches); and quenching the final thickness of steel. Yet further, specific temperatures and cooling rates are provided in accordance with the present invention.

The steel is further provided to have approximate temperatures by reheating of from 1100 to 1180° C. (2000 to 2150° F.) at the start of hot-rolling, and from 14° C. (25° F.) above and 22° C. (40° F.) below the steel's $Ar_3$ temperature on completion of hot-rolling. The cooling rate of the steel during hot-rolling may be approximately 60 to 230° C./min (150 to 450° F./min). Hot-rolling further may specifically include the reducing the thickness of the steel through five or six stands of rolls and specified interstand times between reductions. At least one interstand time is inadequate to allow recrystallization of austenite, and the temperature of the steel at one or more stands is less than the temperature at which austenite will recrystallize. Then the steel is quenched at an approximate cooling rate of from 810 to 1370° C./min (1500–2500° F./min) to a temperature of from 560 to 620° C. (1050 to 1150° F.).

The slab at the end of reheating preferably has a fine average austenite grain size of approximately up to 25 $\mu$m. Addition of vanadium, niobium, or a combination thereof can result in yield strengths exceeding 621 MPa (90 ksi).

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

BEST MODE FOR CARRYING OUT THE INVENTION

The present invention is directed to a composition and process for manufacturing titanium-bearing high-strength low alloy steel that is substantially ferritic (approximately at least 80% and preferably at least 95% ferrite by volume) including, at least in part, an acicular ferrite microstructure, with or without addition of vanadium, niobium, or a combination thereof, by casting a thin slab and controlled rolling the slab to final thickness. The invention is made possible by the relatively high solidification and cooling rates that are available from thin slab casting.

There are three factors primarily responsible for strengthening of the steel of the present invention: grain size refinement, precipitate strengthening, and solid solution strengthening. The largest contributor to strength in the present invention is likely grain size refinement. Factors that help reduce the grain size are: (1) A fine dispersion of TiN, TiC, and Ti(CN); (2) a small (25 $\mu$m or less) initial austenite grain size, as permitted by thin slab casting; and (3) having certain critical temperatures in the rolling process. Dispersion of a fine TiN throughout the grain structure of the steel on solidification and a fine TiC and Ti(CN) that precipitate after completion of deformation caused by thermomechanical controlled processing results in steel that includes very small acicular ferrite in its microstructure.

Precipitate strengthening by second phase particles in the steel (TiN, TiC, Ti(CN), and (FeTi)) also contributes to strength. The two critical factors for the effectiveness of these precipitates as strengtheners are (1) a very fine size and (2) a relatively large volume fraction, such as one to two percent.

Solid solution strengthening is likely the lowest contributor to strength. Solid solution strengthening occurs where elements such as C, Mn, and Ti are dissolved in-the iron in the ferrite grains.

Figure 1:
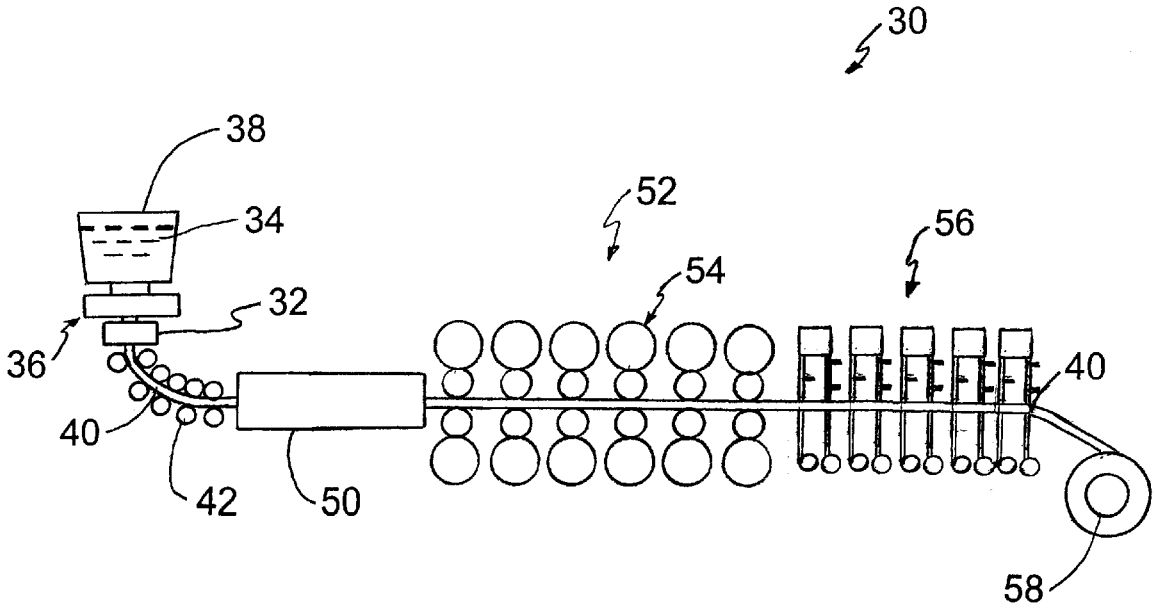
FIG. 1 is a schematic elevation view of a thin-slab casting line for use in the process of the present invention.

FIG. 1 shows a thin-slab casting line 30 used in the present invention. The casting apparatus includes a mold 32 that receives molten steel 34 from a delivery system 36 filled by a ladle 38. The molten steel 34 passes through the mold 32, which has cooled plates that cause the molten steel 34 to solidify on the surfaces, forming a skin that contains the strand 40 of solidifying steel. The strand 40 is guided by pinch rollers 42 and cools to solidify for its entire thickness. The strand 40 then travels through a reheat tunnel furnace 50 in preparation for the hot-mill 52, where the strand 40 is rolled as it passes through multiple roll stands 54. The strand 40 then cools on a runout table 56, where it is subject to accelerated cooling with quenching, and is subsequently coiled by a coiler 58.

Opportunity for grain coarsening occurs when the steel is reheated for hot rolling and austenite grains recrystallize. Relative to thick slab casting, however, thin slab casting has significantly more rapid cooling rates, preventing austenitic grain growth by reducing time above the $Ar_1$ temperature.

Molten carbon steel is used in the process according to the present invention. The molten steel may be produced by any one of a variety of methods known to one of ordinary skill in the art. For example, the molten steel may be made in an electric arc furnace by melting a charge of steel scrap and pig iron, or in a Basic Oxygen Furnace from a charge of steel scrap and molten iron. Fluxes are added to form a floating layer of impurities in a slag, some or most of which can be poured off. Alloying may be performed in the steelmaking furnace, but for improved production efficiency and energy savings is usually performed after transferring the molten steel to a ladle that is subsequently moved to a ladle metallurgy furnace (LMF) for alloying. The molten steel is conventionally partially deoxidized in the steelmaking furnace by addition of a reducing element, most commonly aluminum.

In the LMF, the molten steel is gently agitated by either electromagnetic stirring or by bubbling of an inert gas, such as argon, through ports in the bottom of the ladle. Major alloying is performed with the addition of elements such as manganese. Deoxidization is completed in the LMF, often by addition of more aluminum, which also serves to desulfurize the steel. Inclusions largely accumulate in a slag that forms on top of the steel, which is then floated out of the LMF. Addition of calcium helps to control the shape of remaining aluminum oxide inclusions. Titanium is then added to the steel.

The preferred method of titanium addition is in the form of ferrotitanium wire. The ferrotitanium wire is injected through the slag that forms on top of the steel in the LMF. Addition of titanium prior to desulfurization and deoxidization would result in loss of titanium as titanium oxide in the slag. Bulk titanium could be added, but much of the bulk titanium would similarly be lost in the slag. Using ferrotitanium wire allows injection through the slag inside of refractory tubes. The steel is agitated to distribute the titanium by either inert gas injection or by use of an induction coil that provides electromagnetic stirring. Inert gas injection may result in increased particle agglomeration over electromagnetic stirring, and therefore electromagnetic stirring may be beneficial because titanium nitride particles that form may remain smaller.

Steel according to the present invention has a carbon content of between 0.01 and 0.20%, a manganese content of between 0.50 and 3.00%, and an effective titanium content of 0.01 to 0.12%, with all percentages herein being by weight unless otherwise noted. Titanium will first react with oxygen, nitrogen, and sulfur in the steel. The steel of the present invention is killed, or deoxidized, prior to addition of titanium. Effective titanium content is therefore titanium available for formation of titanium carbide (TiC) and titanium carbonitride (Ti(C,N)) once titanium nitride (TiN) and titanium sulfide (TiS) have formed. Effective titanium ($Ti_{eff}$) is calculated as follows:

$$Ti_{eff}\,\%=Ti_{total}\,\%-(3.4\times N\,\%)-(1.5\times S\,\%).$$

$Ti_{eff}$ is preferably from approximately 0.01 to 0.09%, and the yield strength of steel according to the present invention generally increases proportionally with increase in $Ti_{eff}$ over this range.

Carbon has historically been the most important element for strengthening steel, but is detrimental to weldability and formability, and can require expensive heat treatments such as quenching and tempering to achieve the desired combination of strength and toughness.

Therefore, the carbon content in the steel of the present invention is limited to 0.20%.

Manganese acts to strengthen the steel through mechanisms including solid solution hardening and grain refinement due to depression of the austenite to ferrite transition temperature. Manganese content is limited, however, because at higher percentages it tends to degrade fatigue and formability performance.

The following schedule summarizes the composition of the steel of the present invention, in percent by weight $0.01 \leqq C \leqq 0.20$;

$0.5 \leqq Mn \leqq 3.0$;

$0.008 \leqq N \leqq 0.03$;

$0 \leqq S \leqq 0.5$;

$0.01 \leqq Ti_{eff} \leqq 0.12$;

$0 \leqq Al \leqq 0.08$;

$0 \leqq Si \leqq 2.0$;

$0 \leqq Cr \leqq 1.0$;

$0 \leqq Mo \leqq 1.0$;

$0 \leqq Cu \leqq 3.0$;

$0 \leqq Ni \leqq 1.5$;

$0 \leqq B \leqq 0.1$; and $0 \leqq P \leqq 0.5$, with the balance being iron and incidental impurities. The effective titanium content is preferably from 0.01 to 0.09%. Generally a total titanium content of from 0.03 to 0.15% is required to achieve the cited $Ti_{eff}$, and $Ti_{total}$ is preferably from 0.03 to 0.12%. The aluminum is present as the result of standard killing practice, from which aluminum content will be from 0.005 to 0.08%. To attain desired strength and microstructure, the content of carbon and manganese in particular may need to be adjusted, as readily known to one of skill in the art. For example, if carbon content is 0.03%, the steel of the present invention may require approximately 0.7% manganese. The effects of the elements not previously discussed are also consistent with results that would be expected by one of ordinary skill in the art. In addition, the following microalloy elements may be added to the steel individually or in combination to provide further strengthening or other characteristics:

$0.00 \leqq Nb \leqq 0.15$;

$0.00 \leqq V \leqq 0.15$; and $0.00 \leqq Zr \leqq 0.15$.

The molten steel is cast as a slab with an approximate thickness of from 25 to 100 mm (1 to 4-inches), and preferably 50 mm (2-inches). This relatively thin slab is required because in solidification at the mold 36, the heat extraction rate for the entire volume of the slab is very high. In addition, at the high casting speeds that are in the range of 4 to 6 m/min (13 to 20 ft/min), high post-solidification cooling rates are needed. This combination of rapid heat extraction at solidification and high cooling rates after casting provides a fine distribution of TiN that cannot be obtained in thick slab casting. This creates a fine as-cast austenite structure with a grain size on the order of approximately 25 $\mu$m or less. The austenite does not significantly coarsen in the time and temperature ranges seen in the tunnel furnace 50 between the caster 36 and the finish mill 54.

The thin slab strand 40 is transported through the tunnel furnace 50 to the finish mill 56 for hot-rolling. The slab may be expected to have a temperature of approximately 1010 to 1100° C. (1850 to 2000° F.) on entry into the tunnel furnace 50. The steel is reheated in the tunnel furnace 50 to a temperature approximately between 1100 and 1180° C. (2000 and 2150° F.), providing a substantially homogenized slab with substantially all titanium carbides, nitrides, and carbonitrides dissolved before entering the finish mill 56. There the slab is hot-rolled, including using dynamic recrystallization controlled rolling. In dynamic recrystallization controlled rolling, there is inadequate time between passes through mill stands for static recrystallization to occur. The percent reduction of the slab thickness at each stand along with the time in between each reduction ("interstand times") are approximately as follows:

TABLE 1

| Stand | Reduction (%) | Time (in seconds) |
|---|---|---|
| 1 | 45–55 | 5–30 |
| 2 | 35–45 | 4–25 |

TABLE 1-continued

| Stand | Reduction (%) | Time (in seconds) |
|---|---|---|
| 3 | 10–30 | 4–25 |
| 4 | 10–30 | 3–20 |
| 5 | 10–30 | — |

For the thinnest gauges produced, a sixth stand is sometimes used, with an addition rolling pass reducing the steel from 10 to 30 percent within 3 to 20 seconds of passing through stand 5. At the initial stand, the temperature of the steel is in a range where austenite would recrystallize if given time prior to the next deformation. At one or more later stands, deformation of the steel occurs below the nonrecrystallization temperature, a temperature that is low enough that the austenite will not recrystallize even given time, leading to a very fine ferrite grain from "pancake," highly stressed austenite grains. This is most likely to occur in the later stands, such as the fifth or sixth stands, but may occur earlier.

Appreciable reduction of the slab thickness at each stand 54 provides strain adequate to initiate dynamic recrystallization during deformation, resulting in very fine austenite grain sizes (on the order of 10 $\mu$m or smaller), and consequently very fine polygonal ferrite grain sizes. Moreover, the grain size of acicular ferrite decreases as the titanium content increases. There is a concurrent decrease in polygonal grained ferrite and an increase in acicular ferrite and strength. The acicular ferrite average grain size decreases from approximately 4 $\mu$m to 1 $\mu$m, from when there is no titanium in the steel to when the effective titanium content is approximately 0.09% by weight. X-Ray diffraction and the Scherrer formula were used to determine the average grain size of the acicular ferrite, based on the {110}, {200}, and {211}Bragg peaks for Fe. This in turn was adjusted up by a factor of ten to account for potential analytical issues, in accordance with standard measurement procedures.

The temperature of the steel on exiting the mill 52 is approximately between 14° C. (25° F.) above and 22° C. (40° F.) below the steel's $Ar_3$ temperature. The steel has a temperature of between 560 and 620° C. (1050 and 1150° F.) at the coiler, and is preferably 620° C. (1100° F.). The target temperature at the coiler 58 determines the quench rate on the runout table 56, which is adjusted by selecting the number of cooling sections of the runout table 56 that spray water on the steel, as well as the flow rate of the water. The cooling rates used throughout the process are approximately as follows:

TABLE 2

| Time | Cooling Rate Range | Preferred Cooling Rate |
|---|---|---|
| Immediately after casting | 260 to 370° C./min (500 to 700° F./min) | 310° C./min (600° F./min) |
| Through the finishing mill | 60 to 230° C./min (150 to 450° F./min) | 90° C./min (200° F./min) |
| During quenching between the mill and the coiler | 810 to 1370° C./min (1500–2500° F./min) | — |

The final approximate thickness of the steel is from 1.8 mm to 12.7 mm (0.07-inches to 0.5-inches), and preferably between 2.0 mm and 9.3 mm (0.08-inches and 0.365-inches). Through pinning of austenite grain boundaries, the fine TiN dispersion promotes fine grain size in the material through dynamic recrystallization as it is rolled. Further grain refinement is provided by additional precipitation events of TiC and Ti(C,N) in the steel as it is rolled. This results in steel that includes acicular ferrite in its microstructure, preferably at least 20% by volume when $Ti_{eff}$ is at the low end of the range of the present invention, and increasing as $Ti_{eff}$ increases up to approximately 80% acicular ferrite by volume.

Such a desirable result is difficult to achieve when casting thick slabs without the use of vanadium or niobium. Thick slab operations have higher temperatures in the slab reheat furnace and in the finish mill than in a tunnel furnace used in thin slab casting. The steel In thick slabs is also subject to these higher temperatures for longer periods for example, on the order of two hours in the slab reheat furnace as compared to fifteen or twenty minutes in a thin slab tunnel furnace. Because of the higher temperatures In thick slab casting and the additional time to which the slab is subjected to these high temperatures on being reheated, precipitation of TIC and Ti(C, N) can result in a coarser dispersion of precipitates and significant austenite grain growth that is less likely to occur in thin slabs.

The resulting rolled steel plate, sheet, or strip has a minimum yield strength of at least 345 MPa (50 ksi) and up to approximately 620 MPa (90 ksi). No annealing is necessary. This strength is acquired with titanium as the primary strengthening agent, and although other strengthening agents such as vanadium and niobium may be added to the composition, they are not required. Steel may be made in accordance with the method and composition of the present invention to conform to various standards, for example, Society of Automotive Engineers (SAE) standard J1392, June 1984, grades 050 (X, Y), 060 (X, Y), 070 (X), and 080 (X). The steel may have a minimum tensile strength that exceeds the minimum yield strength by 69 MPa (10 ksi), 103 MPa (15 ksi), or more. The steel may also have relatively high minimum elongation, for example, in excess of 17 percent. With addition of vanadium, niobium, molybdenum, or any combination thereof, the strength of the steel may be increased up to the range of 620 to 760 MPa (90 to 100 ksi).

Figure 2:
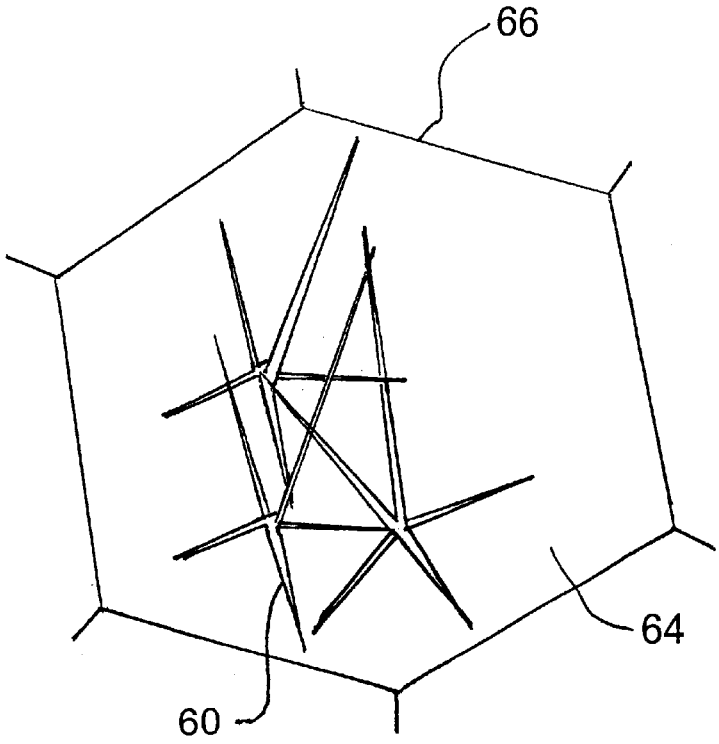
FIG. 2 is a schematic view of a crystal grain of acicular ferrite.
Figure 3:
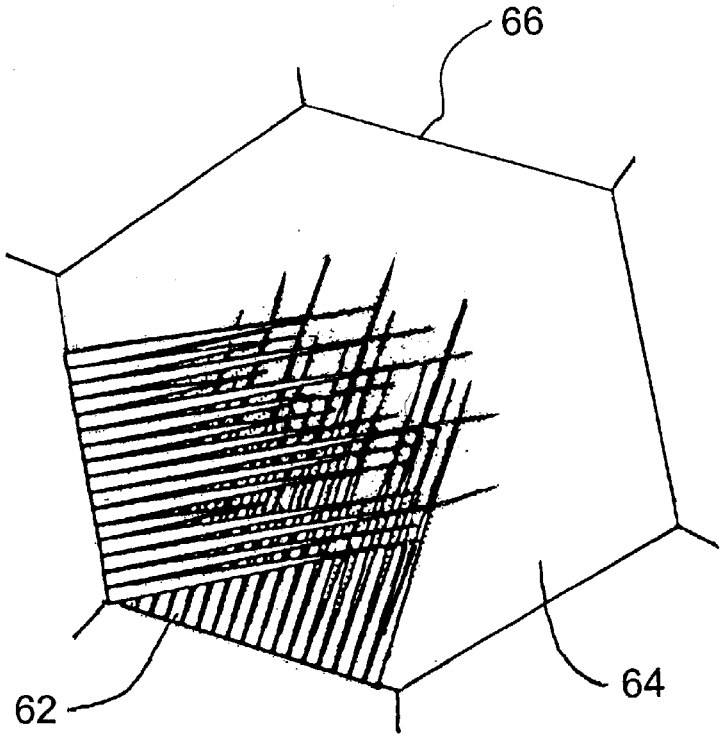
FIG. 3 is a schematic view of a crystal grain of bainite.

FIG. 2 schematically shows the formation of acicular ferrite 60, which transforms from austenite similarly to bainite 62, shown in FIG. 3, but is a different microstructure. Acicular ferrite 60 consists of nonequiaxed ferrite grains. In the formation of acicular ferrite 60, nucleation occurs at point nucleation sites at non-metallic inclusions within untransformed austenite 64 to create a chaotic basket weave microstructure, rather than in a fine sheaf along prior austenite grain boundaries 66 as in bainite 62. The tendency of bainite 62 to form in parallel bundles can allow cracks to propagate easily; conversely, the random orientation of acicular ferrite 60 deters cracking. In addition to acicular ferrite, however, the steel of the present invention may potentially include polygonal ferrite, bainite, pearlite (decreases with increase in titanium content), and martensite (martensite formation generally requires relatively high carbon and molybdenum contents).

EXAMPLES AND DISCUSSION

The following examples and discussion help to further explain the invention, but should be understood to be illustrative and not limiting to the scope of the invention.

Table 3 shows the summarized chemical compositions in percent by weight of several produced test grades of titanium-bearing steel. Sample grade $T_{ref}$ is provided for reference and is not steel of the present invention, and sample grades T1 through T4 are steels of the present invention. Sample V4 is a vanadium-strengthened steel, provided for comparision.

TABLE 3

| Steel | C | Mn | Al | N | S | $Ti_{total}$ | $Ti_{eff}$ | V |
|---|---|---|---|---|---|---|---|---|
| $T_{ref}$ | 0.05 | 0.90 | 0.025 | 0.01 | 0.006 | 0.03 | 0 | — |
| T1 | 0.05 | 0.90 | 0.025 | 0.01 | 0.006 | 0.05 | 0.01 | — |
| T2 | 0.05 | 0.90 | 0.025 | 0.01 | 0.006 | 0.07 | 0.03 | — |
| T3 | 0.05 | 0.90 | 0.025 | 0.01 | 0.006 | 0.09 | 0.05 | — |
| T4 | 0.05 | 0.90 | 0.025 | 0.01 | 0.006 | 0.12 | 0.08 | — |
| V4 | 0.045 | 1.60 | 0.025 | 0.021 | 0.006 | — | — | 0.13 |

For a steel according to the present invention with a carbon content of 0.03 to 0.06% by weight, including sample grades T1, T2, T3, and T4 in Table 3 that are 0.05% carbon by weight, the temperature of the steel is approximately between 840 and 900° C. (1550 and 1650° F.) on leaving the mill, preferably between 860 and 890° C. (1590 and 1630° F.), and more preferably 860° C. (1590° F.).

Table 4 summarizes the ranges of the mechanical properties of the reference steel $T_{ref}$) the four sample grades of titanium-bearing steel, T1 through T4, and vanadium-bearing steel V4, including the yield strength, tensile strength, and percent elongation. Yield strength is determined herein using the 0.2% offset method. It should be noted that the strength of the steel is influenced by factors other than titanium content, such as carbon and manganese contents, and thermal processing and cooling conditions.

TABLE 4

| Steel | Yield MPa (ksi) | Tensile MPa (ksi) | Elongation % |
|---|---|---|---|
| $T_{ref}$ | 290–331 (42–48) | 379–414 (55–60) | 30–36 |
| T1 | 359–414 (50–60) | 441–496 (64–72) | 25–32 |
| T2 | 434–490 (63–71) | 517–586 (75–85) | 22–26 |
| T3 | 490–531 (71–77) | 586–655 (85–95) | 19–24 |
| T4 | 552–621 (80–90) | 621–689 (90–110) | 15–24 |
| V4 | 531–593 (77–86) | 607–676 (88–98) | 19–23 |

Figure 4:
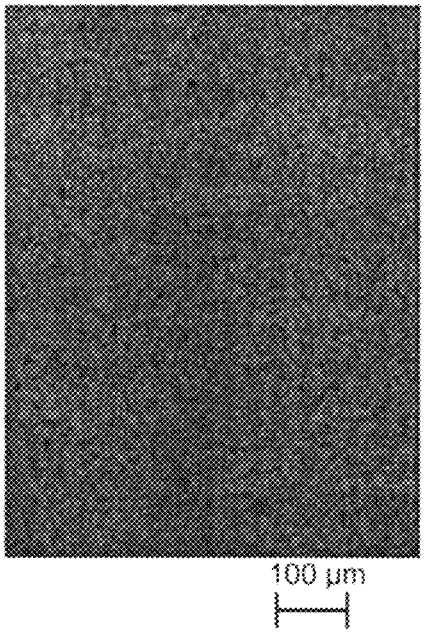
FIG. 4 is a microphotograph of a steel for reference having a total titanium content of 0.03% by weight.
Figure 5:
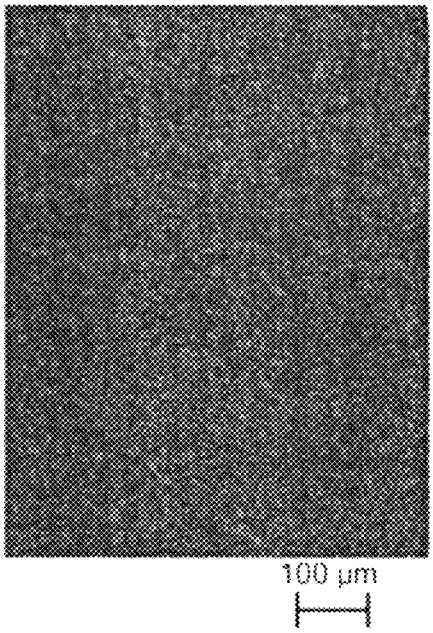
FIG. 5 is a microphotograph of steel of the present invention having a total titanium content of 0.12% by weight.
Figure 6:
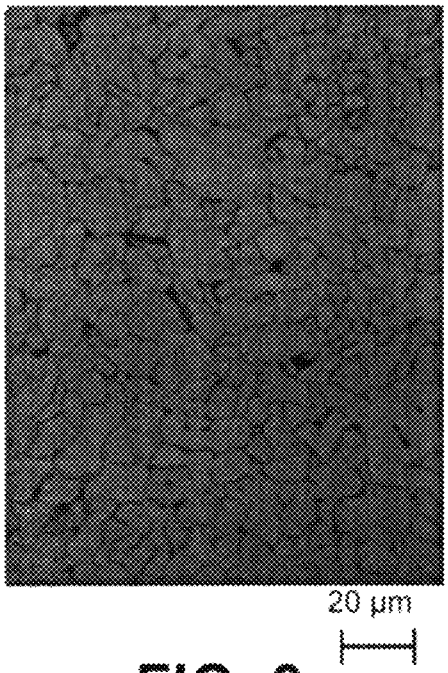
FIG. 6 is an enlarged microphotograph of the reference steel of FIG. 4.
Figure 7:
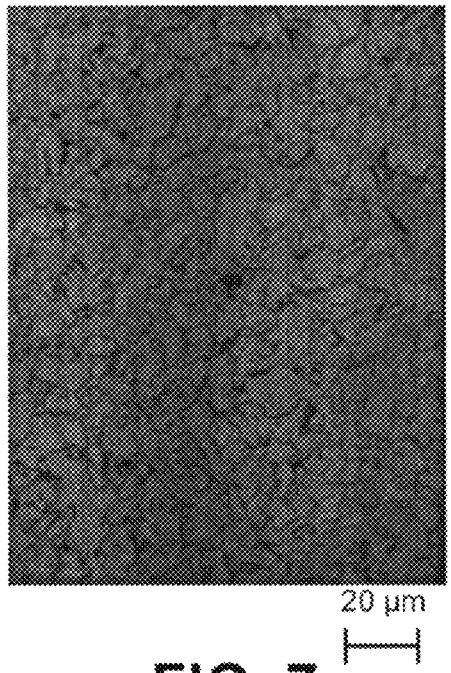
FIGS. 7, 8, and 9 are enlarged microphotographs of the steel of the present invention having a total titanium content of 0.05, 0.07, and, as shown in FIG. 5, 0.12% by weight respectively.
Figure 8:
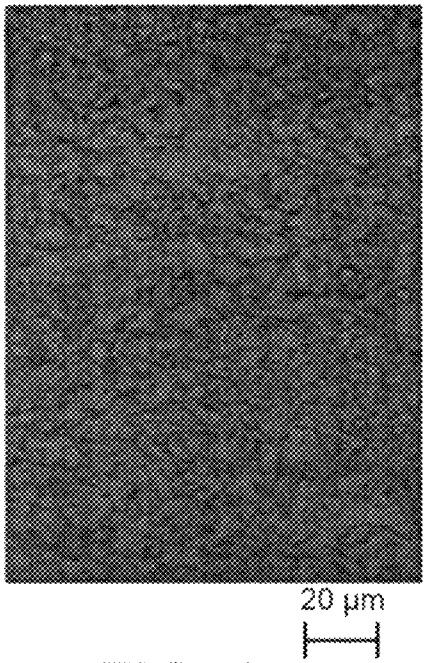
Figure 9:
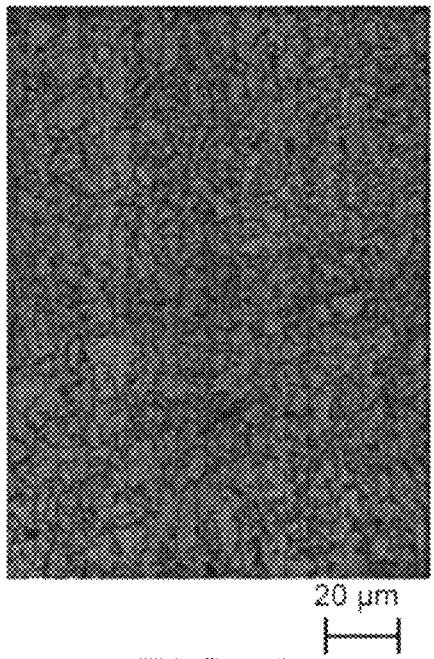

The microphotographs of FIGS. 4 through 9 show increasing amounts of acicular ferrite relative to increases in titanium content for selected sample grades. FIGS. 4 and 6 show $T_{ref}$ (reference sample, 0% $Ti_{eff}$), FIGS. 5 and 9 show grade T4 (0.12% $Ti_{eff}$), FIG. 7 shows grade T1 (0.01% $Ti_{eff}$), and FIG. 8 shows grade T2 (0.03% $Ti_{eff}$). In FIGS. 4 and 6, the $T_{ref}$ ferrite grains are generally large, equiaxed, and polygonal. As titanium content increases grains are increasingly finer, nonequiaxed, and acicular. The amount of acicular ferrite increases from approximately 20% by volume at a $Ti_{eff}$ of 0.01% up to approximately 80% at a $Ti_{eff}$ of 0.09%. Acicular ferrite in excess of approximately 85% by volume can embrittle the steel, and is therefore undesirable. The dark spots in the Figures are pearlite. Pearlite content decreases with increasing titanium content, which is anticipated as titanium increasingly forms TiC.

Figure 10:
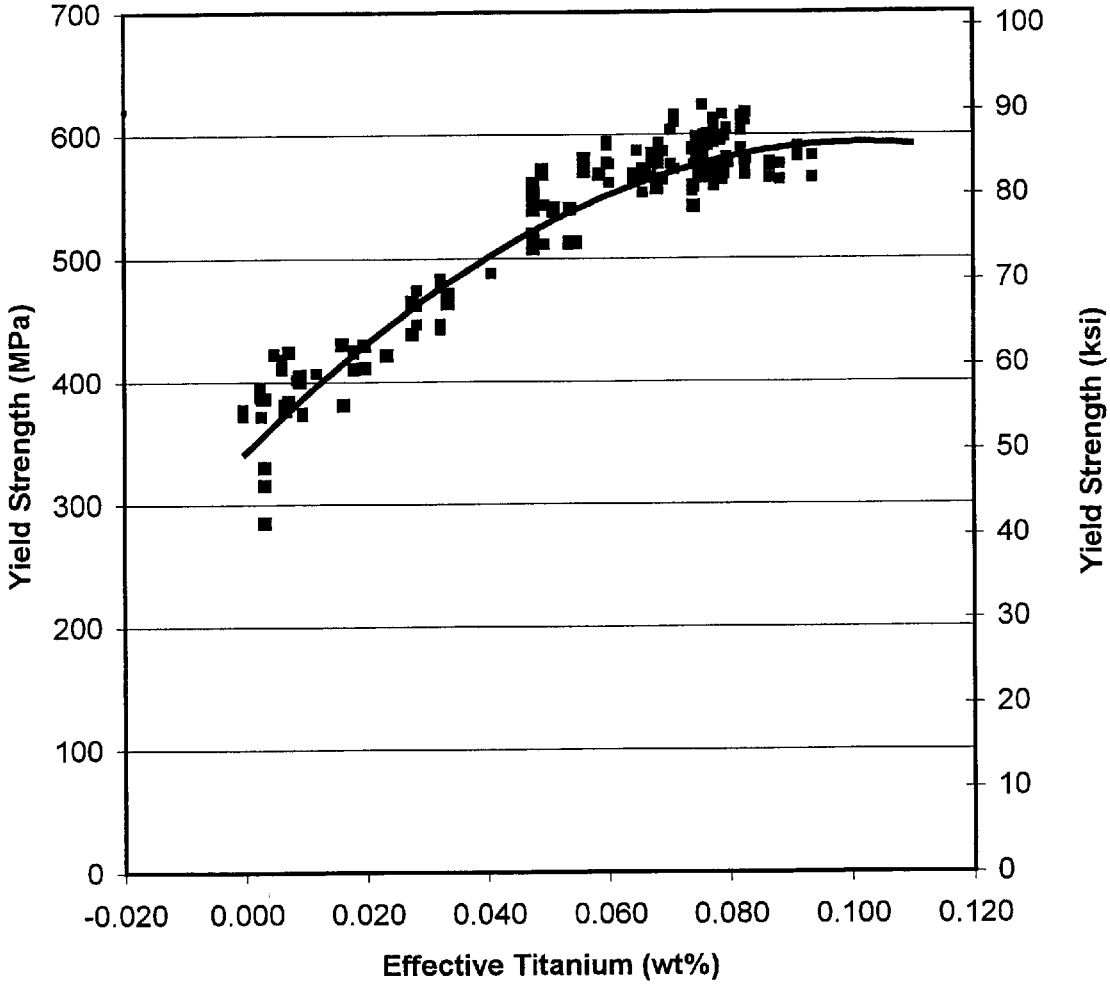
FIG. 10 is a graph of yield strength as a function of effective titanium content for steel of the present invention.

FIG. 10 shows yield strength as a function of titanium content for 49 samples made in 27 heats (some data points overlay each other). Yield strength generally increases proportionally with increasing $Ti_{eff}$ from 0.01 to 0.09% $Ti_{eff}$.

Carbon, manganese, nitrogen, silicon, and total titanium content of several specific samples of the steel of the present invention are listed in Table 5, and their strengths and elongation are provided in Table 6. The samples' temperature on exit of the mill (finish temperature), entry temperature at the coiler (coiling temperature), and gauge are shown in Table 7.

TABLE 5

| Sample | C | Mn | N | S | $Ti_{total}$ |
|---|---|---|---|---|---|
| A | 0.052 | 0.90 | 0.0094 | 0.010 | 0.048 |
| B | 0.051 | 0.83 | 0.0077 | 0.005 | 0.049 |
| C | 0.054 | 0.88 | 0.0096 | 0.006 | 0.067 |
| D | 0.048 | 0.91 | 0.0120 | 0.003 | 0.076 |
| E | 0.048 | 0.91 | 0.0120 | 0.003 | 0.076 |
| F | 0.048 | 0.91 | 0.0120 | 0.003 | 0.076 |
| G | 0.055 | 0.89 | 0.0117 | 0.011 | 0.118 |
| H | 0.051 | 0.89 | 0.0102 | 0.007 | 0.117 |
| I | 0.046 | 0.88 | 0.0095 | 0.012 | 0.127 |
| J | 0.044 | 0.86 | 0.0099 | 0.009 | 0.134 |

TABLE 6

| | | Yield | | Tensile | | Elong. |
|---|---|---|---|---|---|---|
| Sample | $Ti_{eff}$ | MPa | ksi | MPa | ksi | % |
| A | 0.001 | 410 | 59.4 | 488 | 70.8 | 25 |
| B | 0.015 | 426 | 61.8 | 485 | 70.4 | 25 |
| C | 0.025 | 461 | 66.9 | 544 | 78.9 | 23 |
| D | 0.031 | 443 | 64.2 | 525 | 76.1 | 25 |
| E | 0.031 | 475 | 68.9 | 583 | 84.6 | 21 |
| F | 0.031 | 483 | 70.1 | 561° | 81.3 | 24 |
| G | 0.062 | 585 | 84.8 | 672 | 97.5 | 21 |
| H | 0.072 | 596 | 86.4 | 672 | 97.5 | 20 |
| I | 0.077 | 611 | 88.6 | 705 | 102.2 | 21 |
| J | 0.087 | 590 | 85.6 | 665 | 96.5 | 18 |

TABLE 7

| | Finish Temp. | | Coiler Temp. | | Gauge | |
|---|---|---|---|---|---|---|
| Sample | C | F | C | F | mm | 0.001" |
| A | 869 | 1596 | 591 | 1096 | 2.1 | 84 |
| B | 875 | 1607 | 577 | 1071 | 2.0 | 80 |
| C | 866 | 1590 | 594 | 1101 | 3.3 | 131 |
| D | 892 | 1637 | 579 | 1074 | 2.6 | 104 |
| E | 868 | 1595 | 587 | 1088 | 3.5 | 136 |
| F | 865 | 1589 | 611 | 1131 | 3.5 | 138 |
| G | 866 | 1590 | 593 | 1100 | 2.3 | 90 |
| H | 868 | 1594 | 590 | 1094 | 3.5 | 139 |
| I | 866 | 1591 | 597 | 1106 | 5.0 | 195 |
| J | 878 | 1613 | 595 | 1103 | 2.1 | 83 |

Although the invention has been shown and described with respect to a best mode embodiment and other embodiments thereof, it should be understood by those skilled in the art that various changes, omissions, and additions may be made to the form and detail of the disclosed embodiments without departing from the spirit and scope of the invention, as recited in the following claims.

What is claimed is:

1. A process for manufacturing a continuously cast, hot-rolled carbon steel with high strength, comprising:

desulfurizing and deoxidizing a molten carbon steel;

thereafter adding titanium to the molten steel;

continuously casting the molten steel as a thin slab with an approximate thickness of from 25 mm to 100 mm (1-inch to 4-inches) and having a composition by percent weight comprising:

$0.01 \leqq C \leqq 0.20$;

$0.5 \leqq Mn \leqq 3.0$;

$0.008 \leqq N \leqq 0.03$;

$0 \leqq S \leqq 0.5$;

$0.01 \leqq Ti_{eff} \leqq 0.12$;

$0.005 \leqq Al \leqq 0.08$;

$0 \leqq Si \leqq 2.0$;

$0 \leqq Cr \leqq 1.0$;

$0 \leqq Mo \leqq 1.0$;

$0 \leqq Cu \leqq 3.0$;

$0 \leqq Ni \leqq 1.5$;

$0 \leqq B \leqq 0.1$; and $0 \leqq P \leqq 0.5$, with the balance being iron and incidental impurities, $Ti_{eff}$ being the content of titanium not in the form of nitrides, sulfides, or oxides;

hot-rolling the thin slab to an approximate final thickness of from 1.8 mm to 13 mm (0.07-inches to 0.5-inches); and quenching the final thickness of steel.

2. The process according to claim 1, wherein the steel has approximate temperatures of from 1100 to 1180° C. (2000 to 2150° F.) at the start of hot-rolling, and from 14° C. (25° F.) above and 22° C. (40° F.) below the steel's $Ar_3$ temperature on completion of hot-rolling.

3. The process according to claim 2, wherein the cooling rate of the steel during hot-rolling is approximately 60 to 230° C./min (150 to 450° F./min).

4. The process according to claim 1, wherein the step of hot-rolling further comprises the steps of:

reducing the thickness of the steel through a first roll stand by approximately 45 to 55% of the thickness entering the first stand;

after a time period of approximately 5 to 30 seconds, reducing the thickness of the steel through a second roll stand by approximately 35 to 45% of the thickness entering the second stand;

after a time period of approximately 4 to 25 seconds, reducing the thickness of the steel through a third roll stand by approximately 10 to 30% of the thickness entering the third stand;

after a time period of approximately 4 to 25 seconds, reducing the thickness of the steel through a fourth roll stand by approximately 10 to 30% of the thickness entering the fourth stand; and after a time period of approximately 3 to 20 seconds, reducing the thickness of the steel through a fifth roll stand by approximately 10 to 30% of the thickness entering the fifth stand.

5. The process according to claim 4, wherein the temperature of the steel at at least one roll stand is less than the temperature at which austenite will recrystallize.

6. The process according to claim 1, further comprising the step of reheating the cast slab in advance of hot-rolling, to an approximate temperature of from 1100 to 1180° C. (2000 to 2150° F.), the slab at the end of reheating having an average austenite grain size of approximately up to 25 $\mu$m.

7. The process according to claim 1, further comprising the step of quenching the rolled steel at an approximate cooling rate of from 810 to 1370° C./min (1500–2500° F./min).

8. The process according to claim 7, wherein the temperature of the rolled steel is from 560 to 620° C. (1050 to 1150° F.) at the end of quenching.

9. The process according to claim 1, wherein the microstructure of the rolled steel is substantially ferritic and comprises at least 20% acicular ferrite by volume, and the rolled steel has a yield strength of at least 414 MPa (60 ksi).

10. A process for manufacturing a continuously cast, hot-rolled carbon steel with high strength, comprising:

desulfurizing and deoxidizing a molten carbon steel;

thereafter adding titanium to the molten steel;

continuously casting the molten steel as a thin slab with an approximate thickness of from 25 mm to 100 mm (1-inch to 4-inches) and having a composition by percent weight comprising:

$0.01 \leqq C \leqq 0.20$;

$0.5 \leqq Mn \leqq 3.0$;

$0.008 \leqq N \leqq 0.03$;

$0 \leqq S \leqq 0.5$;

$0.01 \leqq Ti_{eff} \leqq 0.12$;

$0.005 \leqq Al \leqq 0.08$;

$0 \leqq Si \leqq 2.0$;

$0 \leqq Cr \leqq 1.0$;

$0 \leqq Mo \leqq 1.0$;

$0 \leqq Cu \leqq 3.0$;

$0 \leqq Ni \leqq 1.5$;

$0 \leqq B \leqq 0.1$; and $0 \leqq P \leqq 0.5$, with the balance being iron and incidental impurities, $Ti_{eff}$ being the content of titanium not in the form of nitrides, sulfides, or oxides;

reheating the cast slab in advance of hot-rolling, to an approximate temperature of from 1100 to 1180° C. (2000 to 2150° F.), the slab at the end of reheating having an average austenite grain size of approximately up to 25 $\mu$m;

hot-rolling the thin slab to an approximate final thickness of from 1.8 mm to 13 mm (0.07-inches to 0.5-inches), wherein the steel has approximate temperatures of from 1100 to 1180° C. (2000 to 2150° F.) at the start of hot-rolling and from 14° C. (25° F.) above and 22° C. (40° F.) below the steel's $Ar_3$ temperature on completion of hot-rolling, the cooling rate of the steel being approximately 60 to 230° C./min (150 to 450° F./min), hot-rolling comprising the steps of:

reducing the thickness of the steel through a first roll stand by 45 to 55% of the thickness entering the first stand;

after a time period of approximately 5 to 30 seconds, reducing the thickness of the steel through a second roll stand by 35 to 45% of the thickness entering the second stand;

after a time period of approximately 4 to 25 seconds, reducing the thickness of the steel through a third roll stand by 10 to 30% of the thickness entering the third stand;

after a time period of approximately 4 to 25 seconds, reducing the thickness of the steel through a fourth roll stand by 10 to 30% of the thickness entering the fourth stand; and after a time period of approximately 3 to 20 seconds, reducing the thickness of the steel through a fifth roll stand by 10 to 30% of the thickness entering the fifth stand, wherein the temperature of the steel at least one roll stand is less than the temperature at which austenite will recrystallize; and quenching the final thickness of steel at an approximate cooling rate of from 810 to 1370° C./min (1500–2500° F./min) to an approximate temperature of from 560 to 620° C. (1050 to 1150° F.) at the end of quenching, wherein the microstructure of the rolled steel is substantially ferritic and comprises at least 20% acicular ferrite by volume, and the rolled steel has a yield strength of at least 345 MPa (50 ksi).

* * * * *